US009513584B2

(12) United States Patent
Gon

(10) Patent No.: US 9,513,584 B2
(45) Date of Patent: Dec. 6, 2016

(54) FIXING DEVICE INCLUDING INDUCTION HEATING SECTION HAVING COVER WITH OPENING ROWS, AND IMAGE FORMING APPARATUS INCLUDING THE SAME

(71) Applicant: KYOCERA Document Solutions Inc., Osaka (JP)

(72) Inventor: Shoko Gon, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/012,228

(22) Filed: Feb. 1, 2016

(65) Prior Publication Data

US 2016/0238976 A1 Aug. 18, 2016

(30) Foreign Application Priority Data

Feb. 18, 2015 (JP) ..... 2015-029679

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2053
USPC ..... 399/328
See application file for complete search history.

(56) References Cited

U.S. PATENT DOCUMENTS

2011/0243621 A1* 10/2011 Gon ..... G03G 15/2053 399/328

FOREIGN PATENT DOCUMENTS

JP 2008-139432 A 6/2008

* cited by examiner

*Primary Examiner* — Quana M Grainger
(74) *Attorney, Agent, or Firm* — Studebaker & Brackett PC

(57) ABSTRACT

A fixing device includes a fixing member and an induction heating section. The fixing member fixes an image onto a sheet. The induction heating section inductively heats the fixing member. The induction heating section includes an annular coil and a cover. The annular coil is elongated in a direction perpendicular to a conveyance direction of the sheet. The cover has first, second, and third opening rows. The annular coil includes first and second linear sections. Both the first and second opening rows are located at a side closer to the first linear section than a center line of the annular coil in the longitudinal direction. The second opening row is located closer to the second linear section than the first opening row. The third opening row is located at a side closer to the second linear section than the center line.

11 Claims, 10 Drawing Sheets

FIXING DEVICE INCLUDING INDUCTION HEATING SECTION HAVING COVER WITH OPENING ROWS, AND IMAGE FORMING APPARATUS INCLUDING THE SAME

INCORPORATION BY REFERENCE

The present application claims priority under 35 U.S.C. §119 to Japanese Patent Application No. 2015-029679, filed on Feb. 18, 2015. The contents of this application are incorporated herein by reference in their entirety.

BACKGROUND

The present disclosure relates to a fixing device and an image forming apparatus.

One example of a fixing device includes a fixing roller, an annular coil that inductively heats the fixing roller, a plurality of magnetic cores that covers the coil, a holding section that holds the plurality of magnetic cores, and a shield member that covers the holding section. The holding section includes a plurality of core receiving sections, a plurality of first openings, and a plurality of second openings. The magnetic cores are disposed in the respective core receiving sections. One first opening forms a pair with one second opening, and each pair is located between adjacent two core receiving sections.

The shield member has a plurality of air inlets, and a plurality of air outlets. The air inlets are located opposite to the respective first openings, and the air outlets are located opposite to the respective second openings. Air introduced through the air inlets passes through the first openings and the second openings, and then released from the air outlets. The coil is cooled by the air introduced through the air inlets.

SUMMARY

A fixing device according to a first aspect of the present disclosure includes a fixing member and an induction heating section. The fixing member fixes an image onto a sheet. The induction heating section inductively heats the fixing member. The induction heating section includes an annular coil, an arched core section, and a cover. The annular coil is elongated in a direction perpendicular to a conveyance direction of the sheet. The arched core section includes a plurality of arched cores. The plurality of arched cores are arranged in a longitudinal direction of the annular coil and disposed so as to straddle the annular coil. The cover covers the arched core section. The cover has a first opening row, a second opening row, and a third opening row. The first opening row includes a plurality of first openings. The plurality of first openings are arranged in the longitudinal direction of the annular coil. The second opening row includes a plurality of second openings. The plurality of second openings are arranged in the longitudinal direction of the annular coil. The third opening row includes a plurality of third openings. The plurality of third openings are arranged in the longitudinal direction of the annular coil. The annular coil includes a first linear section and a second linear section. The first linear section extends in the longitudinal direction of the annular coil. The second linear section extends opposite to the first linear section. Both the first opening row and the second opening row are located at a side closer to the first linear section than a center line of the annular coil in the longitudinal direction. The second opening row is located closer to the second linear section than the first opening row. The third opening row is located at a side closer to the second linear section than the center line.

An image forming apparatus according to a second aspect of the present disclosure includes the fixing device according to the first aspect and an image forming section that forms an image on a sheet.

DETAILED DESCRIPTION

Figure 1:
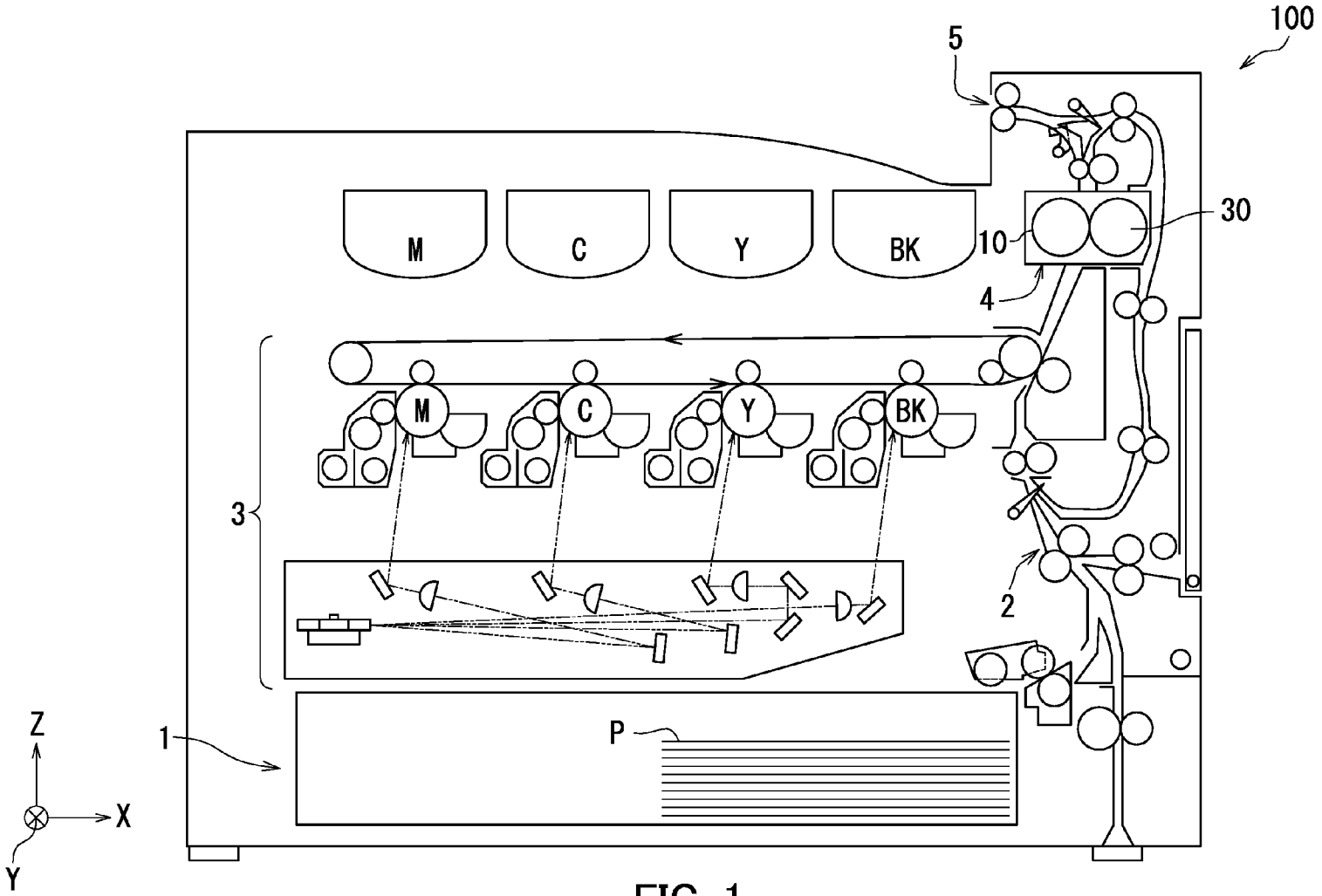
FIG. 1 is a cross-sectional view illustrating an image forming apparatus according to a first embodiment of the present disclosure.

The following describes embodiments of the present disclosure with reference to the accompanying drawings. Elements in the drawings that are the same or equivalent are marked by the same reference sign and the description thereof is not repeated. In the embodiments, an X axis, a Y axis, and a Z axis are perpendicular to one another. The X axis and the Y axis are parallel to a horizontal plane. The Z axis is parallel to a vertical line.

(First Embodiment)

An image forming apparatus 100 according to a first embodiment of the present disclosure will be described with reference to FIG. 1. FIG. 1 is a cross-sectional view illustrating the image forming apparatus 100. The image forming apparatus 100 is a color printer. The image forming apparatus 100 includes a feed section 1, a conveyance section 2, an image forming section 3, a fixing section 4 serving as a fixing device, and an ejecting section 5.

The feed section 1 accommodates a plurality of sheets P and conveys the sheets to the conveyance section 2. The sheets P are for example paper or synthetic resin sheets. The conveyance section 2 includes a plurality of conveyance rollers and conveys a sheet P to the image forming section 3. The image forming section 3 forms an image on a sheet P by electrophotography. The conveyance section 2 conveys the sheet P having the image formed thereon to the fixing section 4. The fixing section 4 applies heat and pressure to the image formed on the sheet P to fix the image onto the sheet P. The conveyance section 2 conveys the sheet P having the image fixed thereon to the ejecting section 5. The ejecting section 5 ejects the sheet P out of the image forming apparatus 100.

Figure 2:
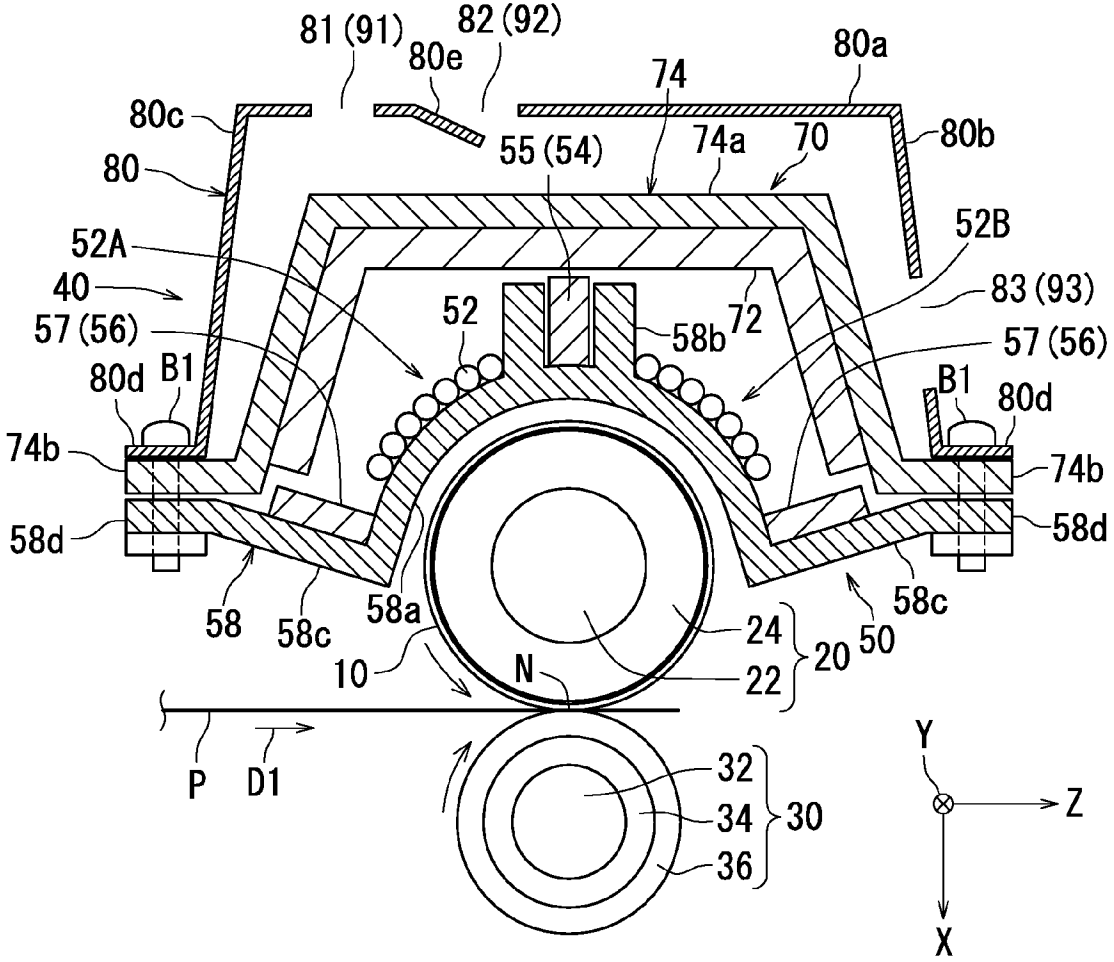
FIG. 2 is a cross-sectional view illustrating a fixing section of the image forming apparatus according to the first embodiment of the present disclosure.

The fixing section 4 will be described with reference to FIG. 2. FIG. 2 is a cross-sectional view illustrating the fixing section 4. The fixing section 4 includes a fixing belt 10 serving as a fixing member, a fixing roller 20, a pressure roller 30, an induction heating section 40, and a plurality of screws B1. The induction heating section 40 includes a coil section 50, an arched core section 70, and a cover 80.

The induction heating section 40 inductively heats the fixing belt 10. As a result of the induction heating, the fixing belt 10 generates heat and fixes an image on a sheet P. The fixing belt 10 is an endless belt and disposed around the fixing roller 20 having a solid cylindrical shape. The fixing belt 10 for example has an inner diameter of 40 mm. The fixing belt 10 is for example formed from a nickel electroformed base, a silicone rubber layer formed on the base, and a release layer formed on the silicone rubber layer. The nickel electroformed base for example has a thickness of no less than 30 μm and no greater than 50 μm. The silicone rubber layer for example has a thickness of no less than 200 μm and no greater than 500 μm. The release layer is for example formed from a fluororesin such as perfluoroalkoxy alkane (PFA). The temperature of the fixing belt 10 is measured using a temperature measuring instrument such as a thermistor and adjusted.

The fixing roller 20 has a solid cylindrical shape. The fixing roller 20 for example has a diameter of 39.8 mm. The fixing roller 20 includes a solid cylindrical metal core 22 and a hollow cylindrical elastic layer 24. The elastic layer 24 is formed on the metal core 22. The metal core 22 is for example formed from stainless steel or aluminum. The elastic layer 24 is elastic and is for example formed from silicone rubber sponge. The elastic layer 24 for example has a thickness of no less than 5 mm and no greater than 10 mm.

The pressure roller 30 has a solid cylindrical shape. The pressure roller 30 for example has a diameter of 35 mm. The pressure roller 30 includes a solid cylindrical metal core 32, a hollow cylindrical elastic layer 34, and a release layer 36. The elastic layer 34 is formed on the metal core 32, and the release layer 36 is formed so as to cover a surface of the elastic layer 34. The metal core 32 is for example formed from stainless steel or aluminum. The elastic layer 34 is elastic and is for example formed from silicone rubber. The elastic layer 34 for example has a thickness of no less than 2 mm and no greater than 5 mm. The release layer 36 is for example formed from a fluororesin such as PFA. The temperature of the pressure roller 30 is measured using a temperature measuring instrument such as a thermistor and adjusted.

The pressure roller 30 is pressed against the fixing roller 20 with the fixing belt 10 therebetween into a pressed contact with the fixing belt 10. The pressure roller 30 and the fixing belt 10 form a nip N at a contact location therebetween. Upon driving and rotation of the pressure roller 30, the fixing belt 10 and the fixing roller 20 passively rotate in accordance with the rotation of the pressure roller 30. A sheet P is conveyed in a sheet conveyance direction D1, and heat and pressure is applied onto the sheet P while the sheet P is passing through the nip N. As a result, an image is fixed onto the sheet P.

Figure 3:
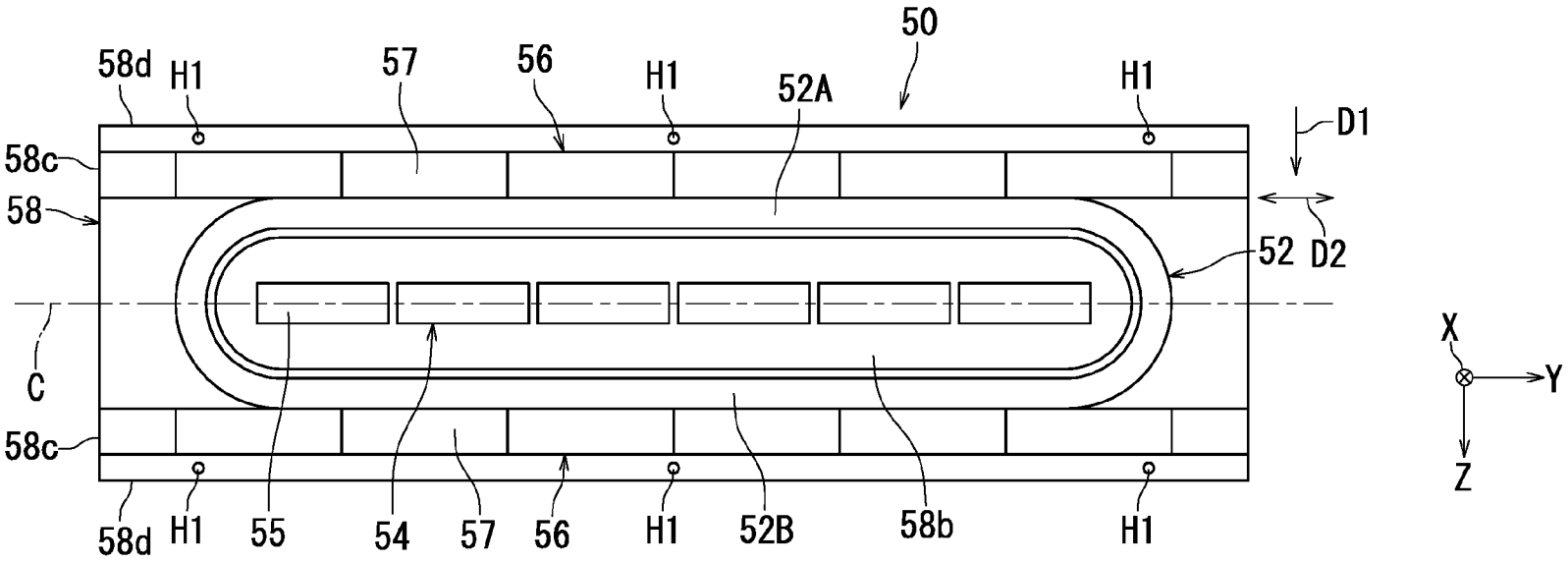
FIG. 3 is a plan view illustrating a coil section of the image forming apparatus according to the first embodiment of the present disclosure.

The coil section 50 of the induction heating section 40 will be described with reference to FIGS. 2 and 3. FIG. 3 is a plan view illustrating the coil section 50. As illustrated in FIGS. 2 and 3, the coil section 50 includes a coil 52, a center core row 54, a pair of side core rows 56, and a base section 58.

The coil 52 is an annular coil that is formed of a conducting wire (for example, Litz wire) wound a plurality of turns and that is elongated in a direction D2 perpendicular to the sheet conveyance direction D1. A longitudinal direction of the coil 52 is substantially the same as the direction D2. Hereinafter, the direction D2 is referred to as the longitudinal direction D2 of the coil 52. The coil 52 includes a first linear section 52A extending in the longitudinal direction D2 of the coil 52 and a second linear section 52B extending opposite to the first linear section 52A.

The coil 52 is spaced a predetermined distance away from the fixing belt 10. The coil 52 is connected with a power supply circuit and supplied by the power supply circuit with a high frequency of alternating current to generate an alternating magnetic flux. The alternating magnetic flux generates eddy currents in the fixing belt 10. The eddy currents cause generation of Joule heat. Thus, the fixing belt 10 generates heat.

Since the coil 52 generates heat, a gas (for example, air) is introduced into the induction heating section 40 to cool the coil 52. The gas that has cooled the coil 52 flows out of the induction heating section 40. The cooling of coil 52 will be described later. Hereinafter, the terms "upstream" and "downstream" may be used. The terms "upstream" and "downstream" mean upstream and downstream in terms of the flow of the gas (air flow) used for cooling the coil 52.

The center core row 54 is located in a region enclosed by the coil 52 in plan view. The center core row 54 includes a plurality of center cores 55. The plurality of center cores 55 are in a linear arrangement along the longitudinal direction D2 of the coil 52. The center cores 55 are for example formed from a magnetic material such as ferrite.

The pair of side core rows 56 are disposed so as to have the coil 52 therebetween. Each of the side core rows 56 includes a plurality of side cores 57. The plurality of side cores 57 in each of the side core rows 56 are in a linear arrangement along the longitudinal direction D2 of the coil 52. The side cores 57 are for example formed from a magnetic material such as ferrite.

The base section 58 includes a bobbin 58*a*, a center core holder 58*b*, a pair of side core holders 58*c*, and a pair of flat portions 58*d*. The bobbin 58*a*, the center core holder 58*b*, the pair of side core holders 58*c*, and the pair of flat portion 58*d* are for example integrally formed.

The base section 58 is for example formed from an insulating synthetic resin. The bobbin 58*a* has a substantially C-shaped cross-section. The coil 52 is fixed to the bobbin 58*a*. The center core holder 58*b* has a substantially U-shaped cross-section and is disposed on top of the bobbin 58*a*. The center core holder 58*b* holds the plurality of center cores 55. The pair of side core holders 58*c* are disposed so as to have the bobbin 58*a* therebetween. Each of the side core holders 58*c* holds the plurality of side cores 57. The pair of flat portions 58*d* are substantially plate-shaped and are disposed so as to have the pair of side core holders 58*c* therebetween. Each of the flat portions 58*d* has a plurality of through holes H1.

Figure 4:
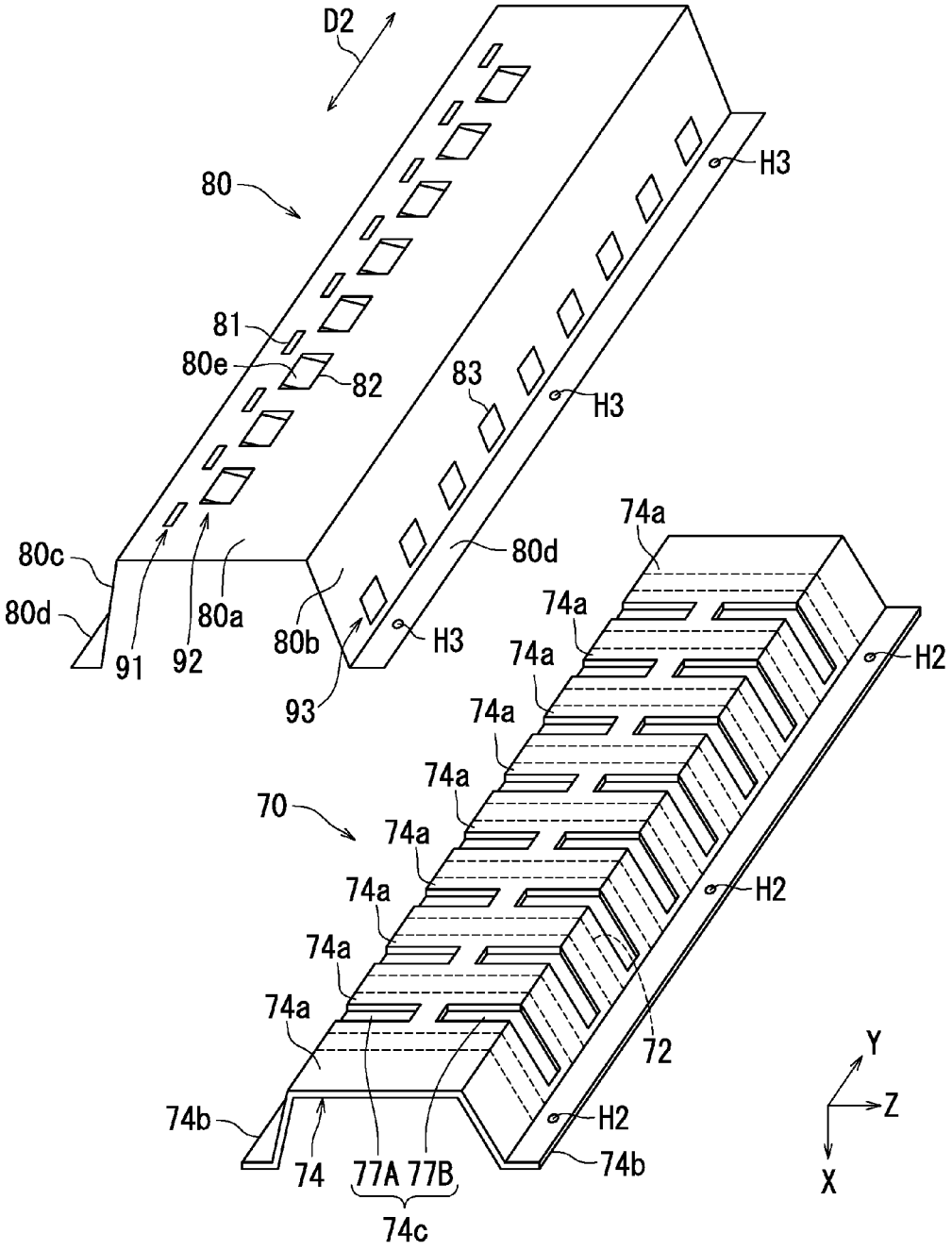
FIG. 4 is an exploded perspective view illustrating an arched core section and a cover of the image forming apparatus according to the first embodiment of the present disclosure.

The arched core section 70 of the induction heating section 40 will be described with reference to FIGS. 2 to 4. FIG. 4 is an exploded perspective view illustrating the arched core section 70 and the cover 80. As illustrated in FIGS. 2 to 4, the arched core section 70 extends in the longitudinal direction D2 of the coil 52 and covers the coil 52. The arched core section 70 includes a plurality of arched cores 72 and an arched core holder 74.

The plurality of arched cores 72 are arranged in the longitudinal direction D2 of the coil 52 and disposed so as to straddle the coil 52. The arched cores 72 are substantially C-shaped and are for example formed from a magnetic material such as ferrite. The magnetic flux generated from the coil 52 is guided by the arched cores 72, the center cores 55, and the side cores 57 to flow along the fixing belt 10. As a result, it is possible to effectively generate eddy currents in the fixing belt 10.

The arched core holder 74 is for example formed from an insulating synthetic resin. The arched core holder 74 holds the plurality of arched cores 72. More specifically, the arched core holder 74 includes a plurality of holding portions 74*a* arranged along the longitudinal direction D2 of the coil 52 and a pair of flat portions 74*b*. The plurality of holding portions 74*a* and the pair of flat portions 74*b* are for example integrally formed. The plurality of holding portions 74*a* are spaced from one another. Each of the holding portions 74*a* has a substantially C-shaped cross-section and holds one arched core 72. The pair of flat portions 74*b* are substantially plate-shaped and disposed so as to have the plurality of holding portions 74*a* therebetween. Each of the flat portions 74*b* has a plurality of through holes H2.

The arched core holder 74 has a plurality of fourth openings 74*c*. Each of the fourth openings 74*c* is formed between adjacent holding portions 74*a*. Each of the fourth openings 74*c* includes an upstream opening 77A and a downstream opening 77B. The upstream openings 77A are opposite to the first linear section 52A of the coil 52, and the downstream openings 77B are opposite to the second linear section 52B of the coil 52. First, second, and third openings 81, 82, and 83 will be described later.

Next, the cover 80 of the induction heating section 40 will be described with reference to FIGS. 2 to 4. As illustrated in FIGS. 2 to 4, the cover 80 covers the arched core section 70. The cover 80 has a substantially C-shaped cross-section and is for example formed from a metal such as aluminum. The cover 80 blocks the magnetic flux generated from the coil 52 to prevent the magnetic flux from leaking out of the induction heating section 40. Furthermore, the cover 80 improves strength of the induction heating section 40. An inner surface of the cover 80 forms part of a flow channel for the gas for cooling the coil 52.

The cover 80 has a top wall portion 80*a*, a side wall portion 80*b*, a side wall portion 80*c*, and a pair of flat portions 80*d*. The top wall portion 80*a*, the side wall portion 80*b*, the side wall portion 80*c*, and the pair of flat portions 80*d* are for example integrally formed.

The pair of flat portions 80*d* are substantially plate-shaped and constitute a pair of side edges of the cover 80. Each of the flat portions 80*d* has a plurality of through holes H3. Each of the screws B1 (FIG. 2) is inserted into one of the through holes H3, one of the through holes H2 of the arched core holder 74, and one of the through holes H1 of the base section 58, so that the cover 80, the arched core section 70, and the coil section 50 are tightened to one another. As a result, the induction heating section 40 has a unitized configuration. The induction heating section 40 is fixed inside the image forming apparatus 100.

The cover 80 has a first opening row 91, a second opening row 92, and a third opening row 93. The first opening row 91 and the second opening row 92 are formed in the top wall portion 80*a*. The third opening row 93 is formed in the side wall portion 80*b*. Both the first opening row 91 and the second opening row 92 are located at a side closer to the first linear section 52A of the coil 52 than a center line C (FIG. 3) of the coil 52 in the longitudinal direction D2. The second opening row 92 is located closer to the second linear section 52B of the coil 52 than the first opening row 91. The third opening row 93 is located at a side closer to the second linear section 52B than the center line C of the coil 52. Thus, the second opening row 92 is located between the first opening row 91 and the third opening row 93.

The first opening row 91 includes the plurality of first openings 81 arranged in the longitudinal direction D2 of the coil 52. The second opening row 92 includes the plurality of second openings 82 arranged in the longitudinal direction D2 of the coil 52. The third opening row 93 is formed in the side wall portion 80*b*. The third opening row 93 includes the plurality of third openings 83 arranged in the longitudinal direction D2 of the coil 52.

A gas (for example, air) that is used for cooling the coil 52 is sent toward the first openings 81 and the second openings 82. The gas sent toward the first openings 81 and the second openings 82 flows into the induction heating section 40, passes through the upstream openings 77A and the downstream openings 77B, and flows out through the third openings 83. The coil 52 is cooled by the gas that flows in through the first openings 81 and the second openings 82 and that flows out through the third openings 83.

More specifically, the gas is sent to the first linear section 52A of the coil 52 through the first openings 81 thereby to cool the first linear section 52A. Furthermore, the gas is sent to the second linear section 52B of the coil 52 through the second openings 82 thereby to cool the second linear section 52B. It is therefore possible to cool the coil 52 while also preventing a difference in temperature from occurring between the first linear section 52A and the second linear section 52B.

Figure 5:
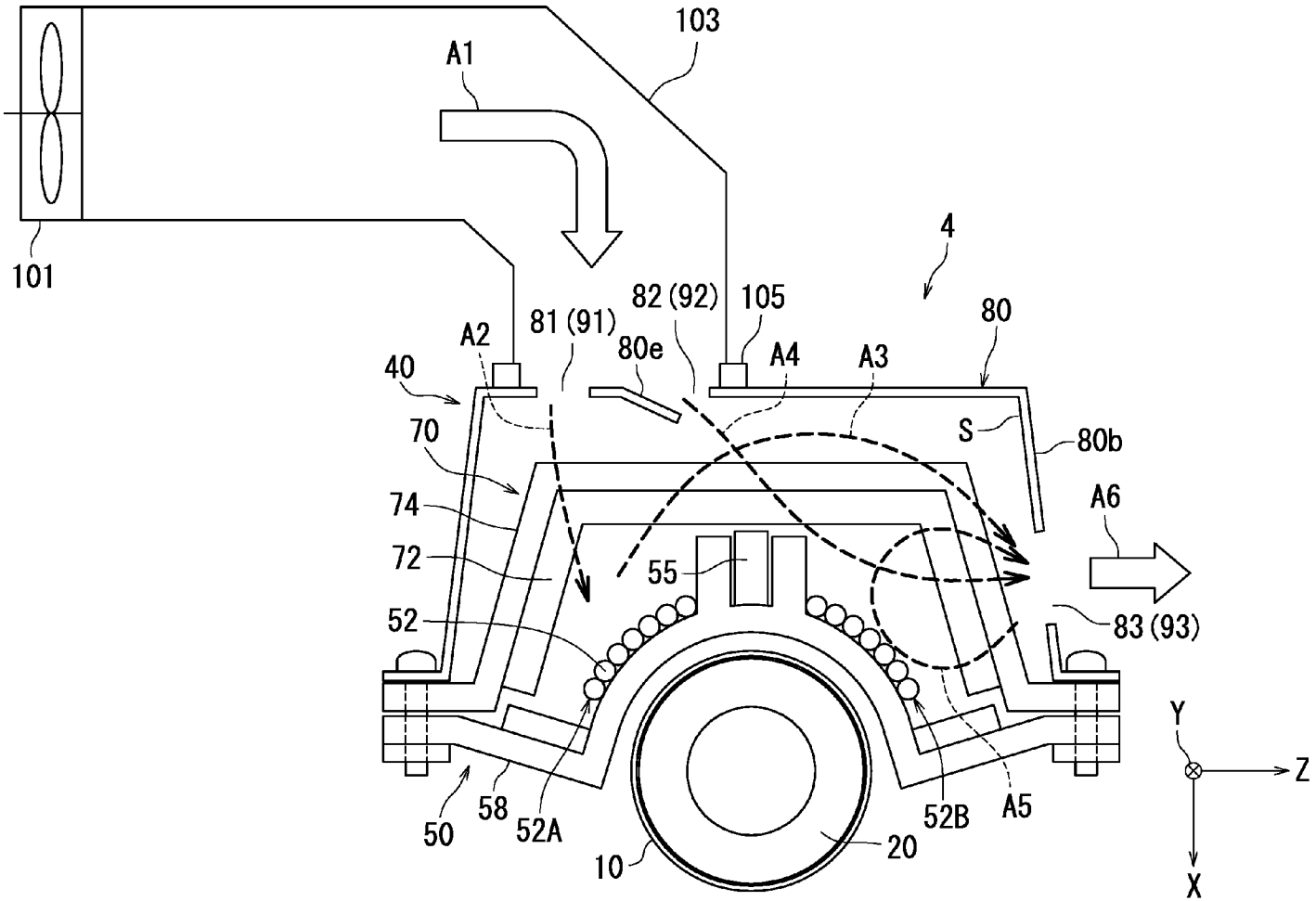
FIG. 5 is a cross-sectional view illustrating flows of gas for cooling a coil of the image forming apparatus according to the first embodiment of the present disclosure.

Flows of the gas for cooling the coil 52 will be described with reference to FIG. 5. FIG. 5 is a cross-sectional view illustrating flows of the gas for cooling the coil 52. The fixing section 4 further includes an intake section 101 serving as a blower, a duct 103, and a seal 105. The intake section 101 for example includes a fan and takes in a gas (for example, air) from the outside of the image forming apparatus 100 to send gas A1 to the duct 103. The duct 103 is connected with the cover 80 with the seal 105 therebetween so as to cover the first opening row 91 and the second opening row 92. The duct 103 guides the gas A1 from the intake section 101 to the first openings 81 forming the first opening row 91 and to the second openings 82 forming the second opening row 92. The seal 105 is for example formed from sponge. The seal 105 is for example in the shape of a rectangular toroid enclosing the first opening row 91 and the second opening row 92.

The gas A1 sent to the first openings 81 is to mainly cool the first linear section 52A of the coil 52. That is, the gas A1 sent to the first openings 81 is blown as gas A2 to the first linear section 52A. The gas A2 then cools the first linear section 52A and flows as gas A3 toward the third openings 83. In this case, the gas A3 flows toward the third openings 83 after passing the coil 52 and the center cores 55.

First guides 80*e* will be described before describing the gas A1 sent to the second openings 82. As illustrated in FIGS. 4 and 5, the cover 80 includes the first guides 80*e*. The first guides 80*e* are plate-shaped and are located at the respective second openings 82. More specifically, each of the first guides 80*e* extends from a section of an opening edge of a corresponding one of the second openings 82 that is farthest from the third openings 83. Each of the first guides 80*e* is inclined toward an interior of the cover 80 at an acute angle relative to the corresponding one of the second openings 82. Each of the first guides 80*e* is for example formed by bending a portion of the cover 80.

The gas A1 sent to the second openings 82 is to mainly cool the second linear section 52B of the coil 52. That is, the gas A1 sent to the second openings 85 is guided as gas A4 by the first guides 80*e* to the second linear section 52B of the coil 52 through the fourth openings 74*c* (FIG. 4). The gas A4 then cools the second linear section 52B and flows toward the third openings 83. The gas A1 sent to the second openings 82 is guided by the first guides 80*e* to an inner surface S of the side wall portion 80*b* of the cover 80, hits the inner surface S to be blown as gas AS to the second linear section 52B through the downstream openings 77B (FIG. 4). The gas AS then cools the second linear section 52B and flows toward the third openings 83.

The gas A3 that has cooled the first linear section 52A, the gas A4 that has cooled the second linear section 52B, and the gas AS that has cooled the second linear section 52B unite together and flow out as gas A6 through the third openings 83.

Figure 6:
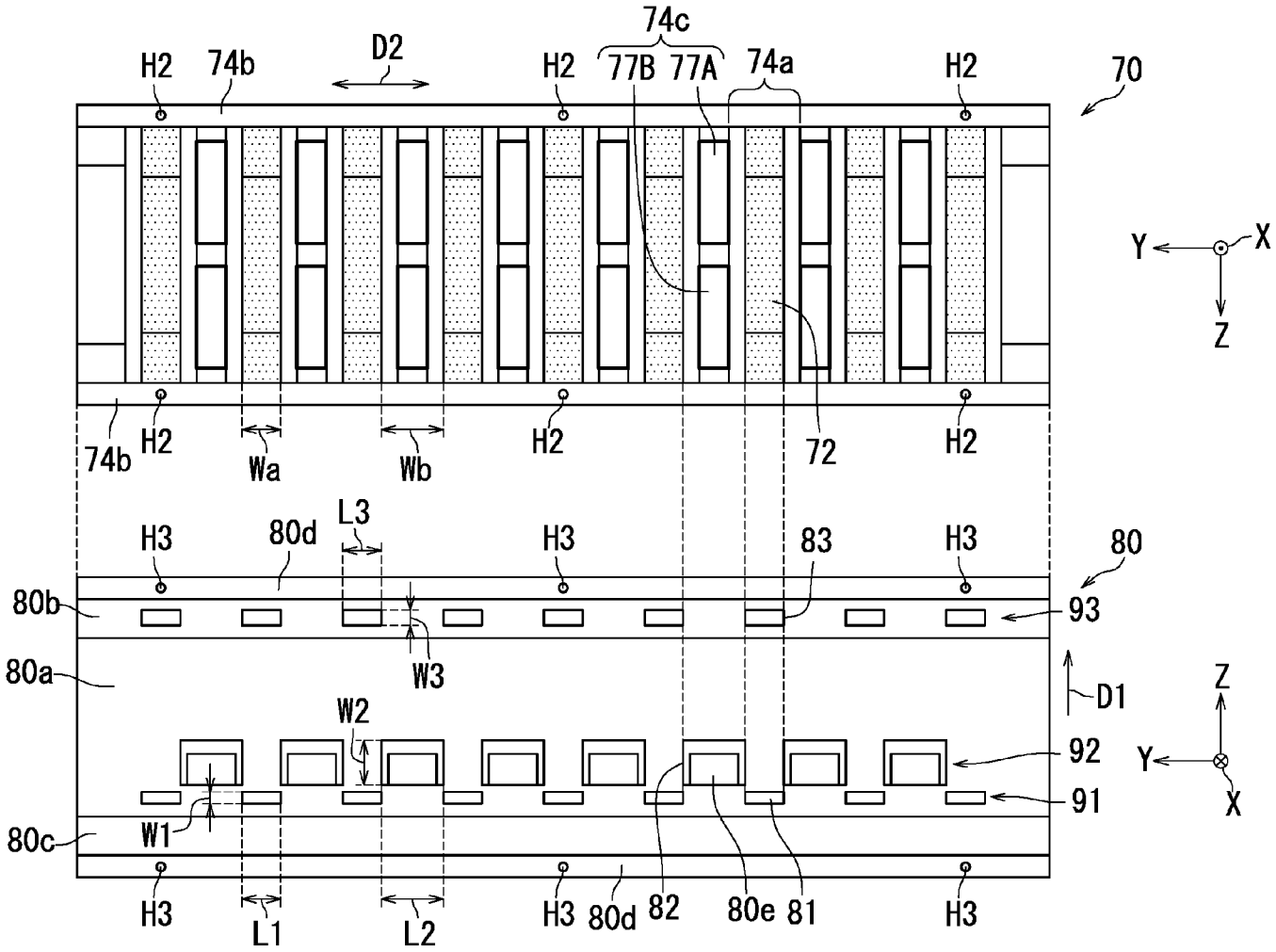
FIG. 6 is a plan view illustrating arrangement of first to third openings of the image forming apparatus according to the first embodiment of the present disclosure.

Arrangement of the first to third openings 81 to 83 will be described with reference to FIG. 6. FIG. 6 is a plan view illustrating arrangement of the first to third openings 81 to 83. FIG. 6 illustrates the arched core section 70 viewed from a side of the coil 52 (FIG. 2) and also illustrates an outer surface of the cover 80.

The first openings 81 are located opposite to the holding portions 74*a*. That is, the first openings 81 are located opposite to the arched cores 72 with the holding portions 74*a* therebetween. The second openings 82 are located opposite to the fourth openings 74*c*. More specifically, the second openings 82 are located opposite to the upstream openings 77A. The third openings 83 are located opposite to the holding portions 74*a*. That is, the third openings 83 are located opposite to the arched cores 72 with the holding portions 74*a* therebetween.

A length L1 of each first opening 81, a length L2 of each second opening 82, and a length L3 of each third opening 83 are determined according to a width Wa of each arched core 72 and a distance Wb between adjacent arched cores 72. The length L1, the length L2, and the length L3 represent a dimension of each first opening 81, a dimension of each second opening 82, and a dimension of each third opening 83, respectively, in the longitudinal direction D2 of the coil 52. The width Wa represents a dimension of each arched core 72 in the longitudinal direction D2 of the coil 52.

A width W1 of each first opening 81, a width W2 of each second opening 82, and a width W3 of each third opening 83 are determined based on a shape of the cover 80. The width W1 is preferably smaller than the width W2. The width W1, the width W2, and the width W3 represent a dimension of each first opening 81, a dimension of each second opening 82, and a dimension of each third opening 83, respectively, in the sheet conveyance direction D1.

In a configuration in which the width Wa is 10 mm and the width Wb is 20 mm, for example, the length L1 is no less than 10 mm and no greater than 20 mm, the width W1 is no less than 5 mm and no greater than 10 mm, the length L2 is no less than 10 mm and no greater than 20 mm, the width W2 is no less than 10 mm and no greater than 15 mm, the length L3 is no less than 10 mm and no greater than 20 mm, and the width W3 is no less than 10 mm and no greater than 20 mm.

According to the first embodiment, as described above with reference to FIGS. 2 to 4, the first linear section 52A is cooled by the gas from the first openings 81, and the second linear section 52B is cooled by the gas from the second openings 82. It is therefore possible to cool the coil 52 while also preventing a difference in temperature from occurring between the first linear section 52A and the second linear section 52B. That is, it is possible to cool the coil 52 while also preventing a difference in temperature from occurring in the coil 52.

According to the first embodiment, as described above with reference to FIGS. 3 and 4, the second openings 82 are located at the side closer to the first linear section 52A of the coil 52 than the center line C of the coil 52 in the longitudinal direction D2. Each of the second openings 82 can therefore be restricted to a smaller area compared to the configuration in which each of the second openings spans across the center line C. It is therefore possible to restrict reduction of the strength of the cover 80 while restricting leakage of the magnetic flux. Furthermore, the first guides 80*e* are farther from the center cores 55 and the coil 52 compared to the configuration in which each of the second openings spans across the center line C. It is therefore possible to prevent the first guides 80*e* from contacting the center cores 55 and the coil 52, ensuring a sufficient distance for insulation.

According to the first embodiment, as described above with reference to FIG. 5, the first guides 80*e* guide the gas sent to the second openings 82 to a space in which the second linear section 52B of the coil 52 is placed. It is therefore possible to effectively cool the second linear section 52B and further prevent a difference in temperature from occurring between the first linear section 52A and the second linear section 52B.

According to the first embodiment, the intake section 101 sends the gas toward the first openings 81 and the second openings 82. It is therefore possible to cause the gas to effectively flow from the first openings 81 and the second openings 82 toward the coil 52.

Furthermore, as described with reference to FIG. 6, the first openings 81 are located opposite to the holding portions 74*a*. The gas from the first openings 81 is therefore blown to the first linear section 52A via the holding portions 74*a*. It is therefore possible to prevent the first linear section 52A from being excessively cooled and prevent a situation in which the second linear section 52B is hard to cool due to the gas that has received heat from the first linear section 52A. The first openings 81 have a smaller area than the second openings 82. This configuration restricts the gas that flows from the first openings 81 toward the first linear section 52A to a smaller amount. It is therefore possible to prevent the first linear section 52A from being excessively cooled and prevent a situation in which the second linear section 52B is hard to cool due to the gas that has received heat from the first linear section 52A.

The second openings 82 are located opposite to the fourth openings 74*c*. It is therefore possible to effectively send the gas from the second openings 82 to the second linear section 52B through the fourth openings 74*c*.

According to the first embodiment, the second openings 82 are located opposite to the fourth openings 74*c* and the third openings 83 are located opposite to the holding portions 74*a*. The gas sent through the second openings 82 therefore passes through the fourth openings 74*c* and hits the inner surface S (FIG. 5) of the cover 80 to be guided to the second linear section 52B. It is therefore possible to further effectively cool the second linear section 52B and further prevent a difference in temperature from occurring between the first linear section 52A and the second linear section 52B.

(Second Embodiment)

The image forming apparatus 100 and the fixing section 4 according to a second embodiment of the present disclosure will be described with reference to FIGS. 1 to 3, 5, and 7 to 9. The image forming apparatus 100 according to the second embodiment has a similar configuration to the image forming apparatus 100 according to the first embodiment illustrated in FIG. 1. The fixing section 4 according to the second embodiment has a similar configuration to the fixing section 4 according to the first embodiment illustrated in FIGS. 2, 3, and 5. However, the fixing section 4 according to the second embodiment is different from the fixing section 4 according to the first embodiment in that the fixing section 4 according to the second embodiment includes a second guide 110A. The following mainly describes differences between the second embodiment and the first embodiment.

Figure 7:
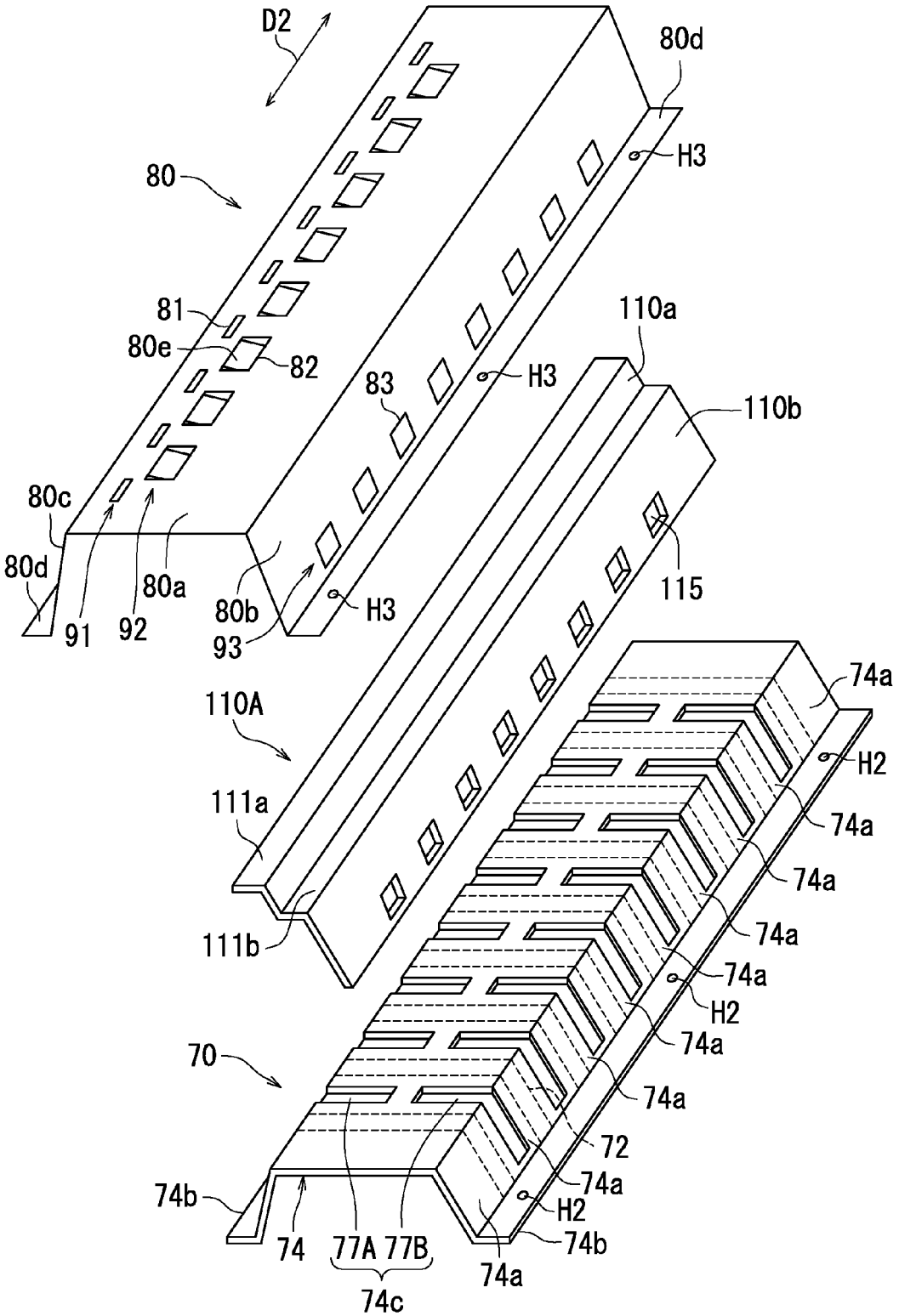
FIG. 7 is an exploded perspective view illustrating an arched core section, a second guide, and a cover of an image forming apparatus according to a second embodiment of the present disclosure.

FIG. 7 is an exploded perspective view illustrating the arched core section 70, the second guide 110A, and the cover 80 of the fixing section 4 according to the second embodiment. The fixing section 4 further includes the second guide 110A. The second guide 110A is disposed between the arched core section 70 and the cover 80, and elongated in the longitudinal direction D2 of the coil 52 (FIG. 3).

The second guide 110A has a first wall portion 110*a*, a second wall portion 110*b*, an upper stage portion 111*a*, and a lower stage portion 111*b*. Both the first wall portion 110*a* and the second wall portion 110*b* extend in the longitudinal direction D2 of the coil 52. The second wall portion 110*b* has a plurality of fifth openings 115 corresponding to the plurality of third openings 83 in the cover 80. The cover 80 covers the second guide 110A and the arched core section 70 such that the third openings 83 overlap the fifth openings 115.

The upper stage portion 111*a* extends from an upper edge of the first wall portion 110*a* at an angle thereto. The upper stage portion 111*a* has a flat top surface. The lower stage portion 111*b* connects a lower edge of the first wall portion 110*a* with an upper edge of the second wall portion 110*b*. The lower stage portion 111*a* has a flat bottom surface.

Figure 8:
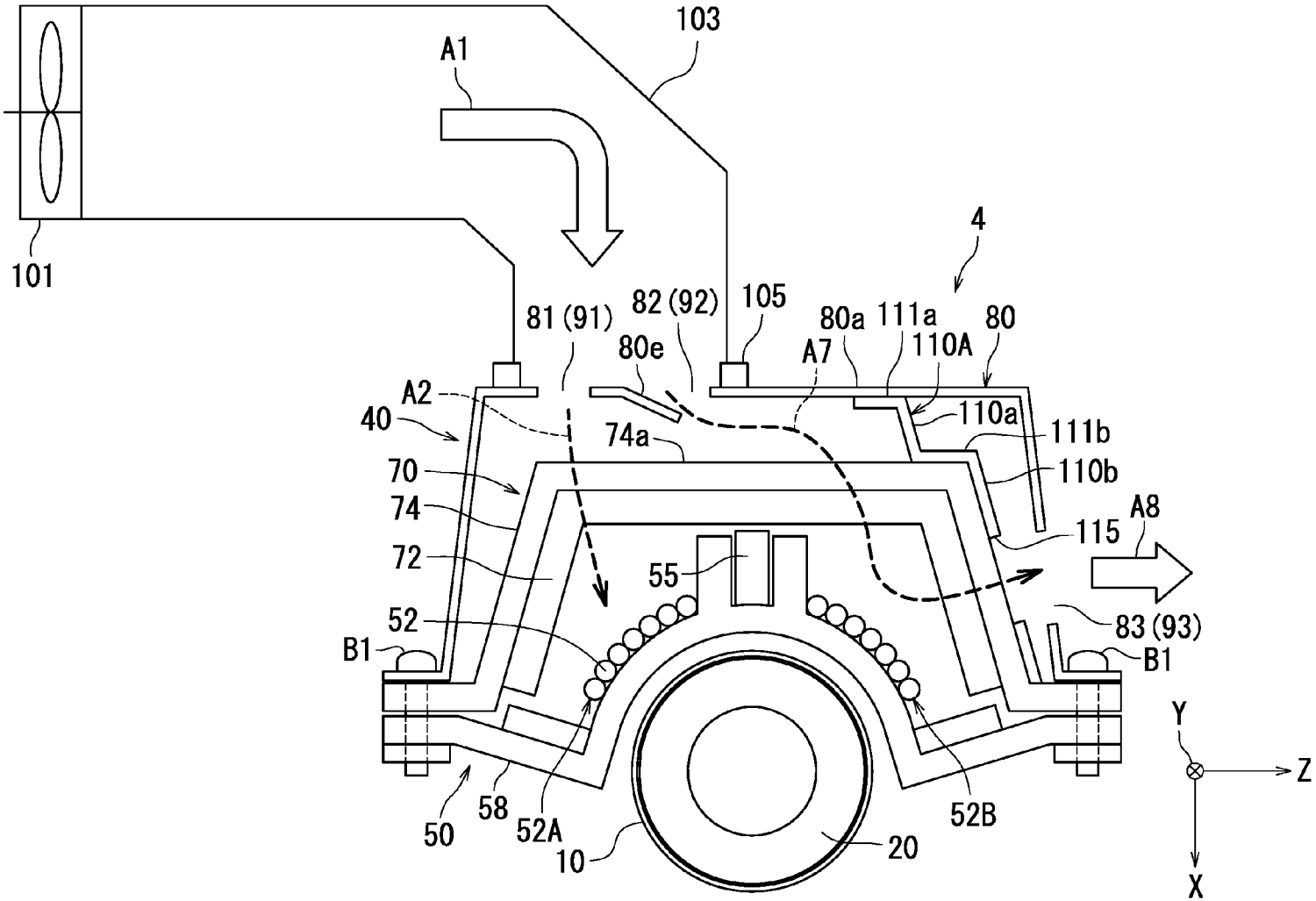
FIG. 8 is a cross-sectional view illustrating flows of gas for cooling a coil of the image forming apparatus according to the second embodiment of the present disclosure.

A function of the second guide 110A will be described with reference to FIG. 8. FIG. 8 is a cross-sectional view illustrating the second guide 110A and flows of gas for cooling the coil 52. The first linear section 52A of the coil 52 is cooled in the same manner as in the cooling of the first linear section 52A described with reference to FIG. 5. The gas A3 and the gas A4 illustrated in FIG. 5 are not illustrated in FIG. 8 in the interest of ease of illustration.

The gas A1 sent to the second openings 82 and guided as gas A7 to the second guide 110A by the first guides 80*e* hits the first wall portion 110*a* of the second guide 110A to be guided to the second linear section 52B of the coil 52 through the downstream openings 77B (FIG. 7). The gas A7 is thus blown to the second linear section 52B, cools the second linear section 52B, and flows toward the third openings 83.

The gas A3 (FIG. 5) that has cooled the first linear section 52A, the gas A4 (FIG. 5) that has cooled the second linear section 52B, and the gas A7 that has cooled the second linear section 52B unite together and flow out as gas A7 through the third openings 83.

Next, mounting of the second guide 110A will be described with reference to FIG. 8. The second guide 110A is disposed between the cover 80 and the arched core holder 74, and is fixed by the cover 80, the arched core holder 74, and the base section 58 tightened to one another with the screws B1. In this configuration, the top surface of the upper stage portion 111*a* of the second guide 110A is restrained by a lower surface of the top wall portion 80*a* of the cover 80, and the bottom surface of the lower stage portion 111*b* of the second guide 110A is restrained by top surfaces of the holding portions 74*a* of the arched core holder 74. An end of the second guide 110A in the longitudinal direction is restrained by a rib formed in the arched core holder 74 and/or an abutment portion formed in a longitudinal end of the cover 80.

Figure 9:
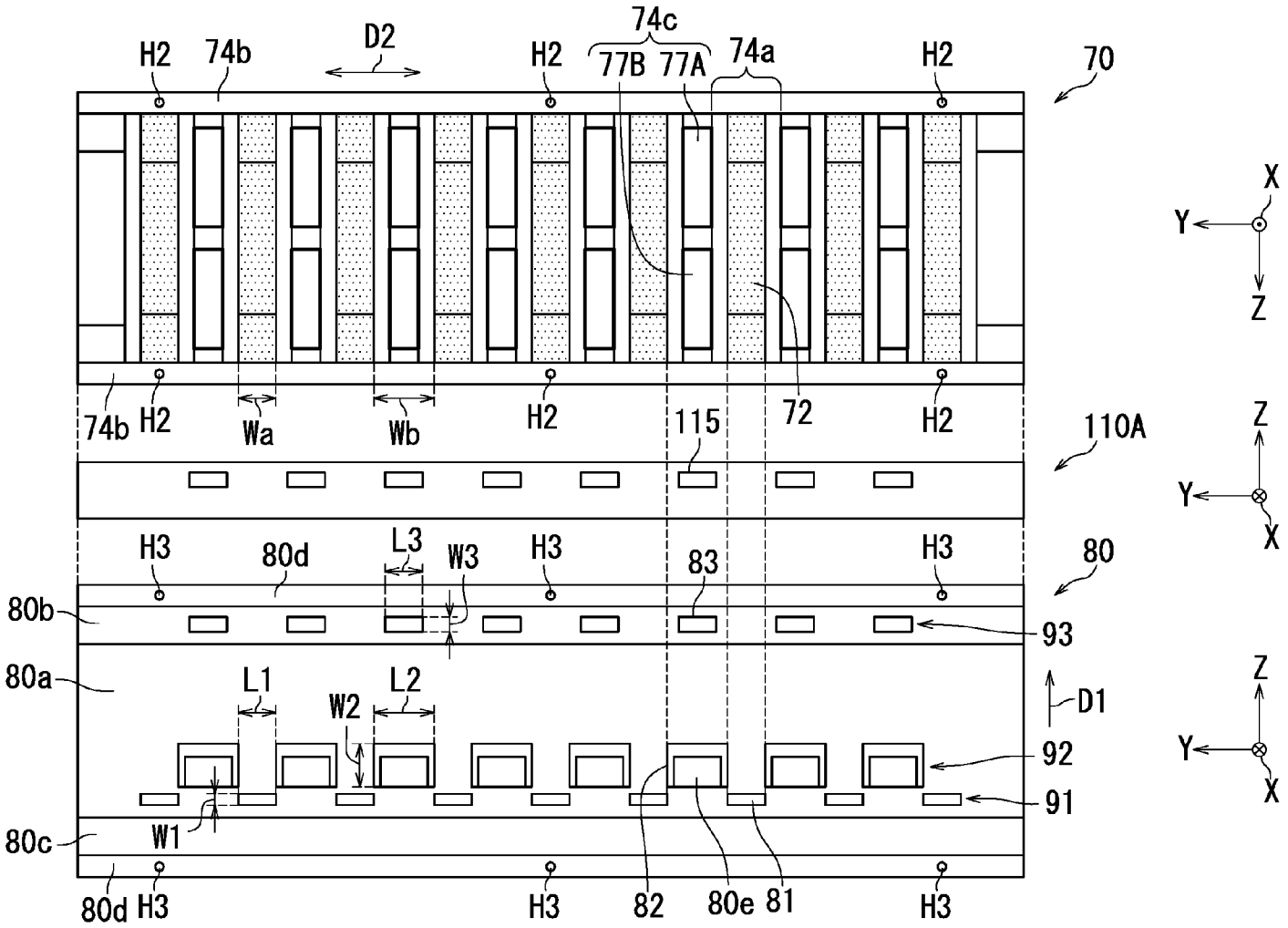
FIG. 9 is a plan view illustrating arrangement of first to third openings of the image forming apparatus according to the second embodiment of the present disclosure.

Arrangement of the first to third openings 81 to 83 will be described with reference to FIG. 9. FIG. 9 is a plan view illustrating arrangement of the first to third openings 81 to 83. FIG. 9 illustrates the arched core section 70 viewed from the side of the coil 52 (FIG. 8), an outer surface of the second guide 110A, and the outer surface of the cover 80.

The first openings 81 are arranged in the same manner as in the arrangement of the first openings 81 according to the first embodiment illustrated in FIG. 6. The second openings 82 are arranged in the same manner as in the arrangement of the second openings 82 according to the first embodiment illustrated in FIG. 6. The third openings 83 and the fifth openings 115 are located opposite to the fourth openings 74*c*. More specifically, the third openings 83 and the fifth openings 115 are located opposite to the downstream openings 77B. The fifth openings 115 for example each have substantially the same area as the third openings 83 or have a larger area than the third openings 83.

The length L1 and the width W1 of each first opening 81, the length L2 and the width W2 of each second opening 82, the length L3 and the width W3 of each third opening 83, the width Wa of each arched core 72, and the distance Wb between adjacent arched cores 72 are determined in the same manner as for the length L1 and the width W1, the length L2 and the width W2, the length L3 and the width W3, the width Wa, and the distance Wb according to the first embodiment illustrated in FIG. 6.

According to the second embodiment, as described above with reference to FIG. 8, the second guide 110A guides the gas coming through the second openings 82 to the second linear section 52B. It is therefore possible to efficiently blow the gas sent through the second openings 82 to the second linear section 52B. As a result, the effect of cooling the second linear section 52B is improved. Since the second embodiment also includes the first openings 81 and the second openings 82, it is possible to cool the coil 52 while also preventing a difference in temperature from occurring in the coil 52 as in the case of the first embodiment. Other than that, the fixing section 4 according to the second embodiment has the same effects as the fixing section 4 according to the first embodiment.

(Third Embodiment)

Figure 10:
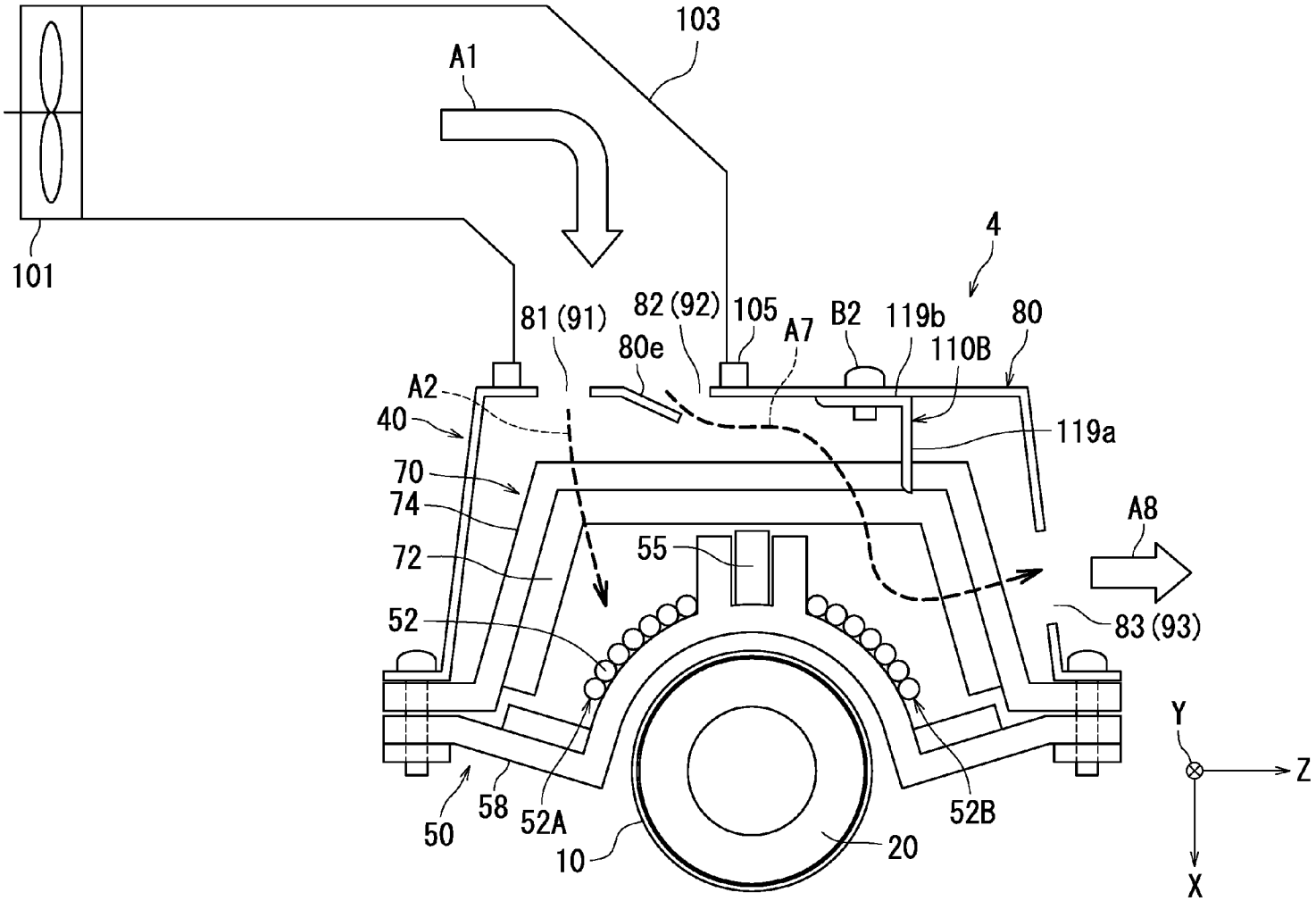
FIG. 10 is a cross-sectional view illustrating flows of gas for cooling a coil of an image forming apparatus according to a third embodiment of the present disclosure.

The image forming apparatus 100 and the fixing section 4 according to a third embodiment of the present disclosure will be described with reference to FIG. 10. The image forming apparatus 100 according to the third embodiment has a similar configuration to the image forming apparatus 100 according to the second embodiment. The fixing section 4 according to the third embodiment has a similar configuration to the fixing section 4 according to the second embodiment. However, the third embodiment includes a second guide 110B instead of the second guide 110A according to the second embodiment. The following mainly describes differences between the third embodiment and the second embodiment.

The second guide 110B will be described with reference to FIG. 10. FIG. 10 is a cross-sectional view illustrating the second guide 110B and flows of gas for cooling the coil 52. The gas A3 and the gas A4 illustrated in FIG. 5 are not illustrated in FIG. 10 in the interest of ease of illustration. The fixing section 4 includes the second guide 110B instead of the second guide 110A and further includes a plurality of screws B2. The second guide 110B has a substantially L-shaped cross-section and includes a wall portion 119*a* and a flat portion 119*b*. The second guide 110B is fixed to the cover 80 by the flat portion 119*b* tightened to the cover 80 with the screws B2. The second guide 110B is elongated in the longitudinal direction D2 (FIG. 3) of the coil 52.

Next, a function of the second guide 110B will be described with reference to FIG. 10. The gas A1 sent to the second openings 82 and guided as the gas A7 to the second guide 110B by the first guides 80*e* hits the wall portion 119*a* of the second guide 110B to be guided to the second linear section 52B of the coil 52 through the downstream openings 77B (FIG. 7). The gas A7 is thus blown to the second linear section 52B, cools the second linear section 52B, and flows toward the third openings 83.

According to the third embodiment, as described above with reference to FIG. 10, the second guide 110B guides the gas coming through the second openings 82 to the second linear section 52B. It is therefore possible to efficiently blow the gas sent through the second openings 82 to the second linear section 52B. As a result, the effect of cooling the second linear section 52B is improved. Since the third embodiment also includes the first openings 81 and the second openings 82, it is possible to cool the coil 52 while also preventing a difference in temperature from occurring in the coil 52 as in the case of the first embodiment. Other than that, the fixing section 4 according to the third embodiment has the same effects as the fixing section 4 according to the first embodiment.

So far, the embodiments of the present disclosure have been described with reference to the accompanying drawings. However, the present disclosure is not limited to the above embodiments and may be implemented in various different forms that do not deviate from the essence of the present disclosure (for example, as described below in sections (1)-(6)). Elements of configuration disclosed in the above embodiments can be combined as appropriate in various different forms. For example, some of the elements of configuration in the embodiments may be omitted. Furthermore, elements of configuration in different embodiments may be combined as appropriate. The drawings schematically illustrate elements of configuration in order to facilitate understanding. Properties of the elements of configuration illustrated in the drawings such as thickness, length, quantity, and spacing may differ from reality in order to aid preparation of the drawings. Properties of elements of configuration described in the above embodiments, such as material properties, shapes, and dimensions, are merely examples and are not intended as specific limitations, and can be altered in various ways to the extent that there is not substantial deviation from the effects of the present disclosure.

(1) Both the third openings 83 and the fifth openings 115 in each of the fixing sections 4 according to the second and third embodiments may be located opposite to the holding portions 74*a*. That is, the third openings 83 may be located opposite to the arched cores 72 with the holding portions 74*a* therebetween, and the fifth openings 115 may be located opposite to the arched cores 72 with the holding portions 74*a* therebetween. Such a fixing section 4 and the fixing sections 4 according to the first to third embodiments may not have the first guides 80*e*. The first openings 81 may be located opposite to the fourth openings 74*c*. More specifically, the first openings 81 may be located opposite to the upstream openings 77A. Such a configuration may or may not include the first guides 80*e*. The third openings 83 in the first embodiment may be located opposite to the fourth openings 74*c*. More specifically, the third openings 83 may be located opposite to the downstream opening 77B.

(2) The second guide 110B of the fixing section 4 according to the third embodiment is a separate member from the cover 80. Alternatively, a second guide having the same function as the second guide 110B can be formed by bending a portion of the cover 80 toward the arched core holder 74. Such a configuration includes the second guide and the cover 80 as an integrated member and therefore can achieve lower manufacturing costs than the configuration in which the second guide is prepared as a separate member. Alternatively, a second guide having the same function as the second guide 110B may be formed integrally with the arched core holder 74.

(3) The numbers of the first to third openings 81 to 83, the fourth openings 74*c*, and the fifth openings 115 in the first to third embodiments are not limited and may be determined as appropriate. The fourth openings 74*c* each include one upstream opening 77A and one downstream opening 77B. Alternatively, the fourth openings 74*c* may each include one, or three or more openings. All of the first to third openings 81 to 83, the fourth openings 74*c*, and the fifth openings 115 are arranged at equal intervals. Alternatively, the openings may be arranged at any intervals. For example, the first openings 81 may be more closely spaced toward the ends from the center of the first opening row 91. The same applies to the second openings 82, the third openings 83, the fourth openings 74*c*, and the fifth openings 115.

(4) Each of the fixing sections 4 in the first to third embodiments may include an exhauster such as a fan. The exhauster releases the gas (gas A6 and gas A8) that has cooled the coil 52 and passed through the third openings 83 out of the image forming apparatus 100. Since the exhauster can effectively release the gas warmed from the heat of the coil 52, the effect of cooling the coil 52 can be further improved. Alternatively or additionally, the fixing section 4 may include a duct for releasing the gas (gas A6 and gas A8) that has cooled the coil 52 and passed through the third openings 83 out of the image forming apparatus 100. Instead of such a duct, the gas may be released for example through an exhaust path extending from the third openings 83 so as to straddle a conveyance path of the sheets P.

(5) The fixing belt 10 of each of the fixing sections 4 in the first to third embodiments may be wound around a plurality of rollers (for example two rollers). The sheet conveyance direction D1 in the first to third embodiments is parallel to the vertical line (Z axis) but may be parallel to the horizontal plane (XY plane).

(6) The image forming apparatus 100 may be a monochrome printer. The image forming apparatus 100 is not limited to a printer and may for example be a copier, a facsimile machine, or a multifunction peripheral.

The present disclosure relates to fixing devices and image forming apparatuses and has industrial applicability.

What is claimed is:

1. A fixing device comprising:

a fixing member configured to fix an image onto a sheet; and an induction heating section configured to inductively heat the fixing member, the induction heating section including:

an annular coil elongated in a direction perpendicular to a conveyance direction of the sheet;

an arched core section including a plurality of arched cores arranged in a longitudinal direction of the annular coil and disposed so as to straddle the annular coil; and a cover that covers the arched core section, the cover having:

a first opening row including a plurality of first openings arranged in the longitudinal direction of the annular coil;

a second opening row including a plurality of second openings arranged in the longitudinal direction of the annular coil; and a third opening row including a plurality of third openings arranged in the longitudinal direction of the annular coil, the annular coil including:

a first linear section extending in the longitudinal direction of the annular coil; and a second linear section extending opposite to the first linear section, wherein both the first opening row and the second opening row are located at a side closer to the first linear section than a center line of the annular coil in the longitudinal direction, the second opening row is located closer to the second linear section than the first opening row, and the third opening row is located at a side closer to the second linear section than the center line.

2. The fixing device according to claim 1, wherein the cover includes a plurality of first guides located at the respective second openings, and the first guides guide gas from the second openings to a space in which the second linear section of the annular coil is placed.

3. The fixing device according to claim 1, further comprising a guide elongated in the longitudinal direction of the annular coil and disposed between the arched core section and the cover, wherein the guide guides gas coming through the second openings to the second linear section of the annular coil.

4. The fixing device according to claim 1, further comprising a blower configured to send gas toward the first openings and the second openings.

5. The fixing device according to claim 1, wherein the arched core section further includes an arched core holder configured to hold the plurality of arched cores, the arched core holder includes a plurality of holding portions configured to hold the respective arched cores, the arched core holder has a plurality of fourth openings that are each located between adjacent two of the holding portions.

6. The fixing device according to claim 5, wherein the first openings are located opposite to the holding portions.

7. The fixing device according to claim 5, wherein the second openings are located opposite to the fourth openings.

8. The fixing device according to claim 5, wherein the third openings are located opposite to the holding portions.

9. The fixing device according to claim 1, wherein the first openings have a smaller area than the second openings.

10. The fixing device according to claim 2, wherein each of the first guides:

is plate shaped;

extends from a section of an opening edge of a corresponding one of the second openings that is farthest from the third openings; and is inclined toward an interior of the cover at an acute angle relative to the corresponding one of the second openings.

11. An image forming apparatus comprising:

the fixing device according to claim 1; and an image forming section configured to form an image on a sheet.

* * * * *